US005735930A

United States Patent [19]

Wanzenberg et al.

[11] Patent Number: 5,735,930

[45] Date of Patent: Apr. 7, 1998

[54] METHOD FOR RESOURCES RECOVERY FROM REFRACTORY CARBONACEOUS MAGMA

[76] Inventors: Fritz W. Wanzenberg; Frederick Wheelock Wanzenberg; Andrew Kimball Wanzenberg; Mark Brooks Wanzenberg, all of 9 Campbell La., Larchmont, N.Y. 10538

[21] Appl. No.: 345,022

[22] Filed: Nov. 25, 1994

[51] Int. Cl.[6] ..... C22B 4/00

[52] U.S. Cl. ..... 75/10.1; 75/10.35; 205/367; 423/332; 423/DIG. 12

[58] Field of Search ..... 205/367; 423/DIG. 12, 423/332; 75/10.1, 10.35

[56] References Cited

U.S. PATENT DOCUMENTS 4,177,064 12/1979 Wanzenberg et al. ..... 75/83

4,569,733 2/1986 Pinkhasov ..... 205/367

5,439,503 8/1995 Burr ..... 75/421

5,536,294 7/1996 Gill et a. ..... 75/359

*Primary Examiner*—Melvyn Andrews

[57] ABSTRACT

A method of refining magma, which includes silicon carbide, basaltic clay, and other insoluble components, including the steps of blending the magma with monovalent alkali hydroxides and a chemical oxidizing agent, melting the magma, and injecting oxygen into the melted magma. The melted magma is electrolyzed to separate metals contained in the melt, which are recovered by gravity separation followed by centrifugation. Soluble silicates are recovered by crystallization.

7 Claims, 3 Drawing Sheets

METHOD FOR RESOURCES RECOVERY FROM REFRACTORY CARBONACEOUS MAGMA

This invention will assure resources recoveries from magma which will eliminate canyon and forest fires and mitigate floods and earthquake damage by converting the world's abundant magma and magmatic detritus into fire retardants, mineral paints and earthquake resistant concrete, while contained metals will pay for global ecological upgrading.

BACKGROUND OF THE INVENTION

Carbonaceous magma was spawned when metal sea ions reduced onto carbonform shoreplates, whereupon tectonic pressure and frictional heat due to overthrusting, subduction and lateral rifting formed strings of volcanoes whose magmatic effluent melted, encapsulating metals in refractory graphite, carbides, carboselenides and carbotellurides; all refractory to conventional mineral dressing but not to the methods of this invention.

In April of 1981, the U.S. Department of the Interior reported producing up to 1,000 ounces of platinum and up to 400 times more gold than platinum from conventional grinding and flotation of magma from San Francisco Bay and California's West-flowing rivers. It was found that flotation was neither cost nor profit effective. By co-producing soluble silicates from magma, this invention will yield these metals from magma cost-effectively.

This invention relates specifically to the recovery of all resources from this refractory carbonaceous magma which is found as basement rock under shoreplate deserts worldwide; and the carbonaceous magmatic black sands burdening rivers, harbors, lakes and reservoirs, also worldwide.

This invention can turn immense magmatic tectonic shoreplates and their detrital black sand spoilbanks into fire retardants and high-strength cements, while preventing floods by their removal, at the same time increasing reservoir capacities, improving navigation and recreation, saving low head hydros from silt erosion from this near diamond-hard carbide/magnetite/rutile detritus. Finally, removal of detrital burden while remediating farm silt will permit fish to spawn in gravel again, thus preserving the fishing industry, worldwide.

This invention is ecologically-safe; there are no harmful effluents; there are no tailings. High strength concrete and soluble hydrated silicates produced by this invention will build flood control infrastructures; preserve vast forests and constrain flooding, worldwide.

America's most burdened area surrounds Mount Saint Helens. This patent will convert its spoilbanks into ecologically- and photosynthesis-safe fire retardants, mineral paints and earthquake-proof high strength hydraulic Portland cement while assuring improved flood control, navigation, fisheries, etc.

State-of-the-art demand for soluble silicates is exemplified by Eka NOBEL AB of Sweden, famous for the Nobel Peace Prize. Nobel will build a sodium silicate plant in Norway during the third quarter of 1994, having a capacity of 55,000 metric tons per year to produce silicate based-products by fusing quartz with hard soda ash at more than 1,200° Centigrade.

The invention produces silicate-based products by fusing refractory silicon and other carbides, the main ingredients of magma, with alkali metal salts and process catalysts at under 250° Centigrade, while freeing the carbide-encapsulated metals. The invention's energy stingy, ecologically-safe approach to produce catalysts; soluble silicates, including anhydrous sodium metasilicate for making cements, hydrated sodium metasilicate for preparing the world's best endothermic fire retardants, etc., and metals at cost-effective levels.

Because this invention will mitigate or prevent flood, fire and earthquake damage, the inventor's believe it merits a U.S. Government grant, to work with the EPA, the Army Corps of Engineers, the U.S. Forestry Service & the U.S. Department of Agriculture and/or the U.S. Geological Survey; ecologically and photosynthesis-safely to put out and prevent canyon and forest fires, prevent floods, prioritize removal of magmatic spoilbanks and river burdens, plan high-strength Portland cement earthquake-proof bridge, cloverleaf and building structures.

The world price for disodium metasilicate crystals is $685 per ton. This invention can produce disodium metasilicate for about $150 per ton from burdened river sands and volcanic spoilbanks while improving and upgrading our ecology. This price includes architectural upgrading of America's flood control system and the remediation of farm silt.

BRIEF DESCRIPTION OF THE INVENTION

In view of the above, it is a broad object of this invention to produce soluble silicates, including disodium metasilicate decahydrate, an endothermic fire retardant which will prevent or extinguish canyon, forest, home, ship and aircraft fires in 5% to 10% solution with water. The soluble silicates produced by this invention are non-toxic, ecologically and photosynthesis-safe to establish firebreaks without loss of trees and lives; while removing the magmatic black sand burden from overburdened rivers and harbors will be a major step in flood control.

It is an object of this invention to produce anhydrous soluble silicates to produce high strength, high temperature resistant hydraulic Portland cement, sauereisen, zeolites; artificial albite, jadeite, nephelite.

It is an object of this invention to recover magnetite from magma for use as nuclear barrier media.

It is an object of this invention to recover rutile from magma which the DuPont Chloride Process and other processes can convert to pigment for use with soluble silicates to produce mineral paints for homes, industries, offices, ships and aircraft.

It is an object of this invention to fuse the silicon carbide fraction of carbonaceous magma with metal salts, oxygen and/or oxygen-carrying chemicals; eutectically and catalytically, and/or self-catalytically, eutectically converting the silicon carbide to soluble silicates and carbon dioxide.

It is an object of this invention to react graphite, carbotellurides and carboselenides with gaseous and/or chemical oxygen in the melt, exothermically, self-catalytically, to yield elemental metals and carbon dioxide in a low-temperature ionized melt.

It is an object of this invention to melt the carbide fraction of the magma, eutectically and catalytically with added metal and ammonium salts, oxychlorides and nitrates to convert the sub-microscopic metals to ionized ammonium chloroplatinates, chlorides and/or amines for electrolytic recovery from the ionized melt.

It is an object of this invention to melt the carbide fraction of the magma eutectically and catalytically to recover from the melt: soluble silicates as crystals, sequentially in order of their respective crystallization temperatures; while recovering the melt-insoluble elemental metals, minerals and basaltic clays.

It is an object of this invention to separate the insoluble metals, including the metals extracted electrolytically from the ionized melt from the insoluble non-metals by mass differential centrifugation and electrophoresis.

These and other objects, as will become evident from the remainder of this specification, are proven when reference is made to the following EXAMPLES and detailed descriptions of the preferred embodiment of this invention, set forth by examples cited; the chemical formulae and physical chemical experiments the inventors have used to perfect process and production methods and the optimization experiments performed to achieve ecological safety, optimum exothermic fire retardation of fire-retardants and mineral paints; the development of strong cements, where anhydrous soluble silica powder, mixed with calcined magmatic basalt and minerals from magma make the strongest plasters and cements.

BRIEF DESCRIPTION OF THE FLOWSHEET

This invention will be better understood when taken in conjunction with the block diagram, FIG. 1:

DESCRIPTION OF THE PREFERRED EMBODIMENTS OF THE INVENTION

Figure 1:
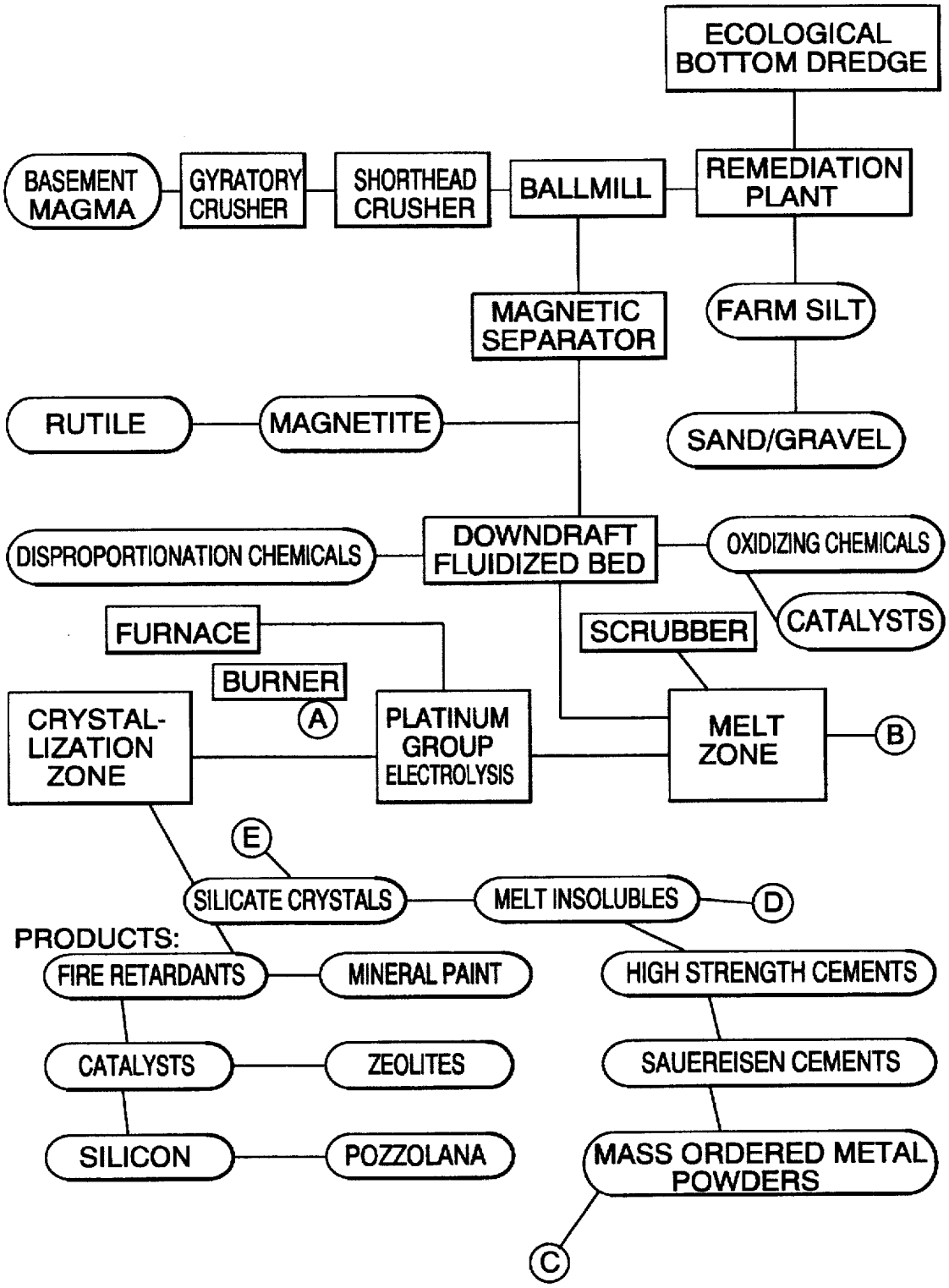
FIG. 1 is a diagramatic view, in block form, showing the direct or reverse fluidized bed method of treating magma in accordance with the invention.

As used herein, "the patents", etc. means U.S. Pat. Nos. 3,979,205, 3,819,363 and 4,177,064. Where the Patents refer to the "DIRECT RETORT METHOD OF PYRALYSIS", FIG. 1 shows this invention employs a reversed or downdraft fluidized bed to react the submicroscopic platinum group metals gold and other metals and their compounds, such as tellurides and selenides with ammonia and ammonia compounds, oxygen, chlorine, oxychlorides, and catalysts cited in the patents.

While the block diagrams contained in the drawings generally speak for themselves, brief summary of the operation of the process shown in FIGS. 1, 2 and 3 will be set forth, following which various examples will be given concerning the materials, chemical formulae and conitions used in the process.

FIG. 1 generally shows two magmatic sources, basement or hardrock magma and dredged or detrital magma. Following mineral dressing and concentration, the fine non-magnetic magma is mixed with oxidizing and disproportionation chemicals, heated in reverse or downdraft fluidized bed, pyrolyzates condensed, melted, metals and melt-insolubles extracted and soluble silicates crystallized, each output to yield other products. The following sample products are pyralyzed and recondensed by downdraft onto itself in the reversed fluidized bed downdraft section shown in FIG. 2.

Figure 2:
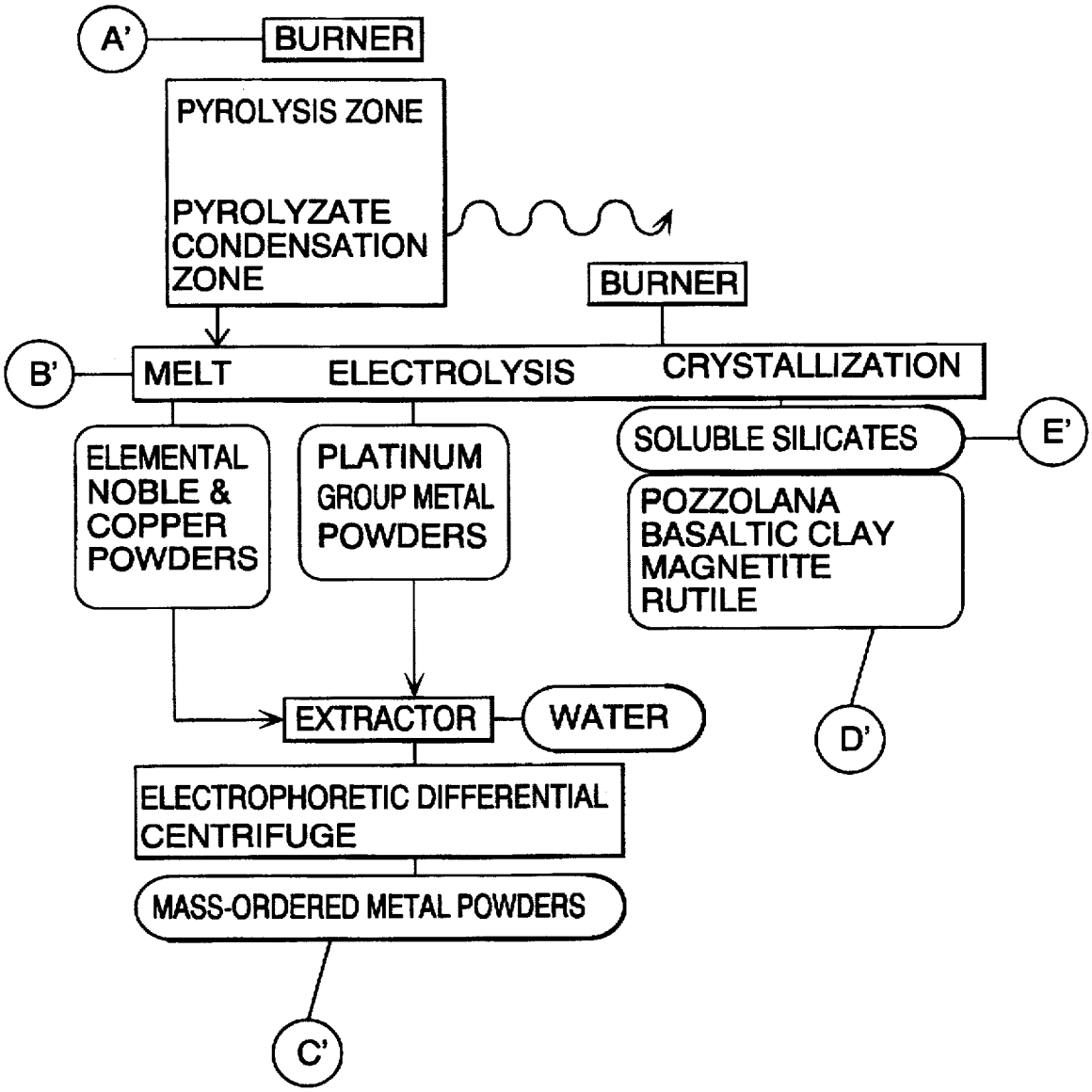
FIG.2 is a fragmentary diagramatic view, in block form, showing certain steps of the indirect pyrolysis method of the invention.
Figure 3:
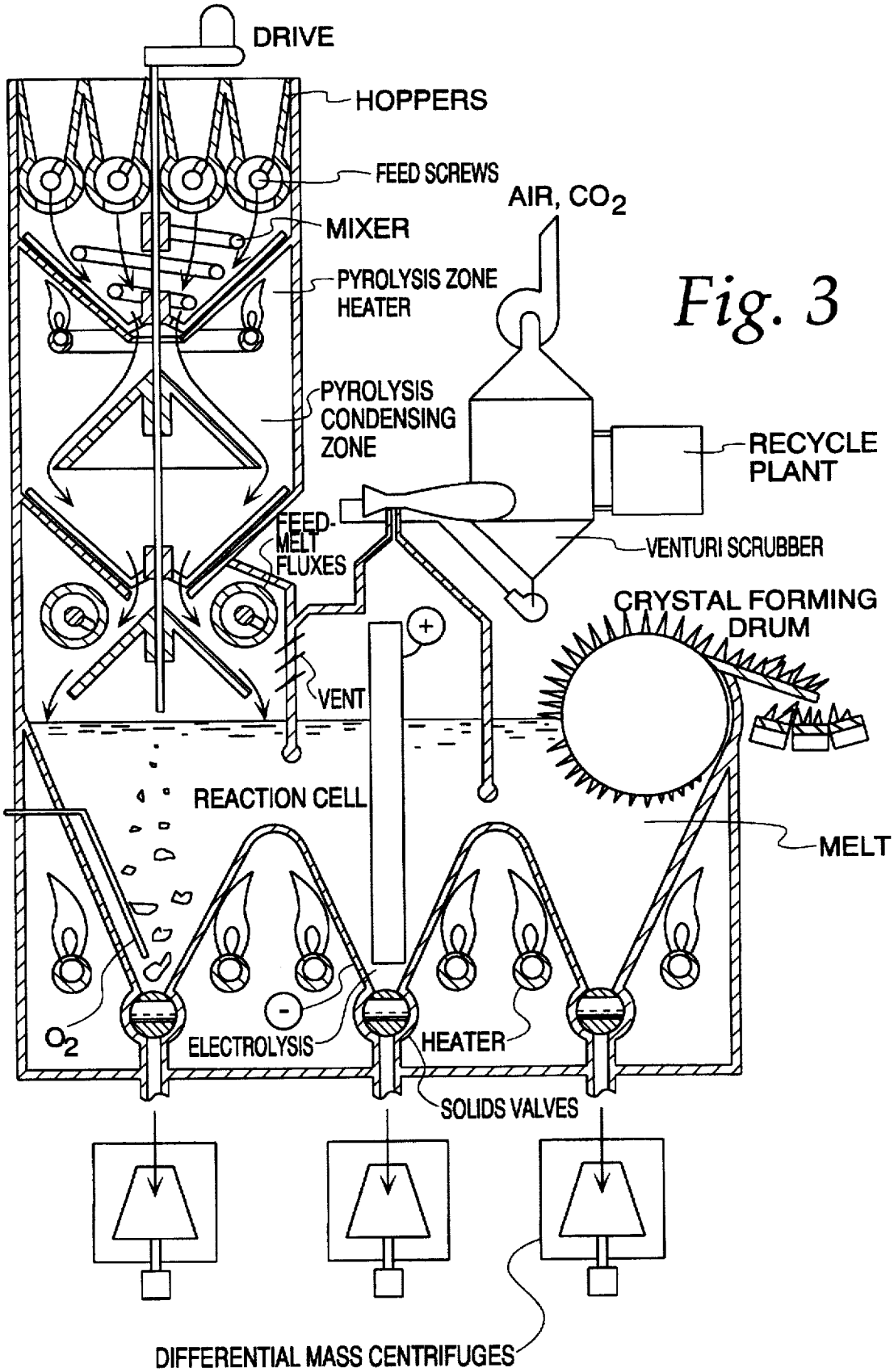
FIG. 3 is a cross-section of the indirect pyrolysis or reverse fluidized bed method of the invention.

FIG. 3 is a flow diagram of proces components A-B-C-D in FIG. 1, corresponding to A'-B'-C'-D' in FIG. 2.

TYPICAL RECONDENSED PYROLYZATES

Gold chloride Tetrammine tetrachloropallidate

Osmium trichloride Trinitrotetrammine cobalt

Rhodium trichloride Platinum dioxetrihydrate,

Palladium Chloride Platinum Trichloride

Ruthenium trichloride Iridium trichloride

These metal pyrolyzates are shown downdrafted mixed with fine already pyralyzed and cooled magma. The recondensed pyrolyzates, fine magma carbides and melt fluxes dissolve as a homogeneous ionic melt from which disodium metasilicate and other soluble silicates crystallize on a chilled drum, while the metal ions in the ionized fusion melt are electrolytically recovered as fine metal powders, as shown in FIG. 3.

Under precise temperature control, each soluble silicate type is crystallized out of the melt; washed, dried and ground, as shown in FIG. 2, mixed with calcine to make cements as illustrated in the formula: CALCINED MEDIA/SOLUBLE SILICATES is equal to or greater than 1; or dissolved in water for fire retardants and mineral paint, etc.

The larger metal particles, minerals and basaltic clays are insoluble in the melt, are augered out, washed and classified by mass differential centrifugation and/or electrophoresis.

INDIRECT RECONDENSING METHOD OF PYROLYSIS

In the patents, pyrolyzates were condensed in scrubbers or melted in a reduction furnace. When the scrubber hypochlorite solution was sufficiently pregnant with metal ions, metals were recovered by electrolytic reduction.

The patents recovered the gold and platinum group pyrolyzates in hypochlorite. Needed was direct recovery without tailings.

The inventors analysed the magma by slicing it into wafers and counting the visible gold, copper and platinum particles. We began developing a system using the exothermic properties of carbonaceous magma to melt it with minimum fuel by using this invention to react exothermically with the refractory metals-encapsulating graphite, carbides, carbo-tellurides and carbo-selenides. After many trials in the Nevada desert, we found that we could indeed recover the gold and platinum from the graphite, carbo-tellurides and carbo-selenides exothermically. Then, having substituted ecologically-safe hypochlorite successfully over traditional poisonous cyanide, we experimented with pentanary metal eutectics to eliminate poisonous lead from the traditional binary fire assay. This accomplished, we successfully dissolved magmatic carbides, using the catalytic eutectic approach first on pyrolyzates, then on refractory carbides, then pyrolyzates and carbides combined.

By combining the chemistry of the patents, including pyrolozates, with metal salts, catalytically and eutectically, we converted magmatic carbides exothermically with minimum fuel, to water-thin fusions at ever lower temperatures so we could then recover the soluble silicates by crystallization and the visible metals by gravity separation from the melt. This is the basis for this invention.

The fusion components were crystallized out of the melt. The anhydrous crystals made a super strong cement which we cast into fireproof shingles with the calcined melt-insolubles. Diluted with water, the crystals were sprayed on trees, shrubbery and logs. The growing plants continued to flourish so the spraying had no ill-effect on photosynthesis. Upon drying to efflorescence, the sprayed items would not burn.

We prepared mineral paints by adding titanium pigment and water to the crystals with equal success in blocking flames. Merck Index specifications showed we had produced disodium metasilicate nonahydrate, an endothermic fire retardant, produced by NOBEL and others by fusing quartz with hard soda ash. This invention had produced it by fusing magmatic carbides with pyrolyzates by indirection, while attempting to strip refractory encapsulations from metals in magma, using the exothermic nature of carbonaceous magma to reduce the fuel needed for fusion.

The foregoing is the basis for this invention, where our primary objectives have become the economic production of disodium and other soluble silicates, once tailed-out as waste.

In the following EXAMPLES, pyrolyzates are recondensed onto the magmatic infeed. Along with the recondensed pyrolyzates, additive and indigenous chemicals and catalysts are dissolved in the complex fusion melt; whereupon the eutectically ionized metal compounds are reduced to powders by electrolysis, while the oversize metals drop out of the melt by gravity, washed and mass-centrifuged from basalt and other melt-insolubles, for recovery.

EXAMPLE 1

One hundred units of carbonaceous magma is crushed and ground to minus 100 mesh, equal to 254 micron particle-size, the 100 units equate to 80.2 units of contained carbide. To this is mixed 6.44 units of sodium chlorate and the mixture heated to 270° C.; or, until pink, brown, ochre, greenish-black, red, crimson and/or olive-green pyrolyzate vapors begin to form above the mixture, in a tall pyrex glass vessel. The heated, pyrolized contents are mixed with 80 units of sodium hydroxide and. heated to 320° C. An oxygen lance is used exothermically to burn the carbide and graphite carbonaceous fractions and supply oxygen to complete the reaction to metasilicate. After melting and liquifying the contents, metals are recovered from the melt-ionized pyrolyzates by electrolytic reduction, after which disodium metasilicate and other soluble silicates are crystallized out of the melt. The melt-insolubles are recovered from the remaining melt:

(Metal+graphitic, (Cg) magma, carbidic, (SIC) magma)

$$SiC+ClO_3^-+O_2 \rightarrow \text{pyrolyzate chlorides}+CO_2$$

$$SiC+2NaOH+2O_2 \rightarrow Na_2SiO_3+CO_2+H_2O$$

EXAMPLE 2

Same as EXAMPLE 1, except for different chemistry:

$$(\text{Metal+C magma})+NH_4ClO_4 \rightarrow \text{pyralyzate chlorides, amines}$$

$$SiC+2OH+Na_2O_2+O_2 \rightarrow Na_2SiO_3+CO_2+H_2O$$

EXAMPLE 3

Same as EXAMPLE 1, except for different chemistry:

$$SiC+2KOH+O \rightarrow K_2SiO_3+CO_2+H_2O$$

EXAMPLE 4

Same as EXAMPLE 1, except for different chemistry:

$$SiC+2LiOH+O_2 \rightarrow Li_2SiO_3+CO_2+H_2O$$

EXAMPLE 5

Same as EXAMPLE 1, except for different chemistry:

$$3SiC+2NaOH+2KOH+2LiOH+3O_2 \rightarrow Na_2SiO_3+K_2SiO_3+Li_2SiO_3+3CO_2+3H_2O$$

EXAMPLE 6

Same as EXAMPLE 1, except quartz was dominent over silican carbide in the magma; and graphite, (Cg), also a significant part of magma is burned:

$$SiO_2+Cg+2OH+Na_2O_2 \rightarrow Na_2SiO_3+CO_2+H_2O$$

EXAMPLE 7

Same as EXAMPLE 1, except that silica or quartz, carbides and graphite, (Cg) are both significant components of the magma, ore or magmatic detritus:

$$SiC+SiO_2+Cg+4OH+2Na_2O_2+O_2 \rightarrow 2Na_2SiO_3+2CO_2+H_2O$$

Preferred embodiments of the invention having been described by way of examples, it is anticipated that modifications and changes to the methods shown may be made without departing from the spirit of the invention or the scope of the appended claims.

What is claimed is:

1. A method of refining magma comprising the steps of:

providing an amount of magma which includes silicon carbide, basaltic clay, metals and other insoluble components;

blending said magma with one or more monovalent alkali hydroxides and a chemical oxidizing agent in amounts effective to lower the melting temperature of the magma to below about 320° C.;

melting said magma to form a melt;

injecting oxygen into said melt in amounts effective for reacting with silicon carbide and monovalent alkali hydroxides to produce soluble silicates;

electrolyzing said melt to reduce metals contained in said melt;

removing metals, basaltic clay and other insoluble components from said melt by gravity separation;

recovering by centrifugation said metals, basalt and other insolubles removed from said melt by gravity separation; and cooling said melt to a temperature effective for crystallizing soluble silicates in said melt.

2. The method of claim 1, wherein, after oxygen is injected into said melt, insoluble components, including metals and basaltic clay, are recovered from the melt by gravity separation and then centrifugation.

3. The method claim 2, wherein, after electrolyzing, metals and basaltic clay are recovered from the melt by gravity separation and then centrifugation.

4. The method of claim 3, wherein the soluble silicates are crystallized on a drum surface by cooling said melt on the drum to a temperature effective for crystallizing the soluble silicates.

5. The method of claim 4, wherein basaltic clay is recovered by gravity separation and then centrifugation after the soluble silicates have been crystallized.

6. The method of claim 1, wherein one or more monovalent alkali hydroxides are added in amounts to reduce the melting temperature of magma from about 1100° C. to about 250°–320° C.

7. The method of claim 1, wherein said chemical oxidizing agent is selected from the group consisting of sodium chlorate and $Na_2O_2$.

* * * * *